US010928098B1

(12) United States Patent
Varghese

(10) Patent No.: US 10,928,098 B1
(45) Date of Patent: Feb. 23, 2021

(54) MULTISTAGE AIR COMPRESSOR UNIT AND METHOD OF USE

(71) Applicant: Sibu Varghese, Sugar Land, TX (US)

(72) Inventor: Sibu Varghese, Sugar Land, TX (US)

( * ) Notice: Subject to any disclaimer, the term of this patent is extended or adjusted under 35 U.S.C. 154(b) by 64 days.

(21) Appl. No.: 16/417,823

(22) Filed: May 21, 2019

Related U.S. Application Data

(60) Provisional application No. 62/674,232, filed on May 21, 2018.

(51) Int. Cl.

| | |
|---|---|
| ***F24H 3/02*** | (2006.01) |
| ***F04D 29/40*** | (2006.01) |
| ***F04D 19/02*** | (2006.01) |
| ***F24H 9/00*** | (2006.01) |

(52) U.S. Cl.
CPC ..... *F24H 3/02* (2013.01); *F04D 19/02* (2013.01); *F04D 29/403* (2013.01); *F24H 9/0063* (2013.01)

(58) Field of Classification Search
None
See application file for complete search history.

(56) References Cited

U.S. PATENT DOCUMENTS

| | | | | |
|---|---|---|---|---|
| 3,291,115 | A * | 12/1966 | Forniti | F24C 3/042 126/92 R |
| 5,215,718 | A * | 6/1993 | Katzer | B01L 7/00 34/80 |
| 6,195,907 | B1 * | 3/2001 | Bodnar | B08B 3/026 15/345 |
| 6,305,325 | B1 * | 10/2001 | Sullivan | A01K 13/001 119/600 |
| 7,175,424 | B2 * | 2/2007 | Frink | F24C 3/006 126/519 |
| 8,641,413 | B2 * | 2/2014 | Chen | F23C 7/02 431/309 |
| 9,328,927 | B2 * | 5/2016 | Wang | F23D 14/14 |
| 9,404,671 | B2 * | 8/2016 | Liang | F24H 3/006 |
| 9,726,368 | B2 * | 8/2017 | Chen | F23D 3/04 |
| 10,101,036 | B2 * | 10/2018 | Fuller | F24C 1/14 |
| 10,729,218 | B2 * | 8/2020 | Childe | H02K 1/2706 |
| 2008/0202502 | A1 * | 8/2008 | Eckhardt | F24C 3/04 126/92 AC |

* cited by examiner

*Primary Examiner* — David J Laux
(74) *Attorney, Agent, or Firm* — Richard Eldredge; Leavitt Eldredge Law Firm

(57) ABSTRACT

A multistage air compressor unit includes an air inlet; a turbo axial compressor operated via a motor; a heating element in direct communication with the turbo axial fan blade; and a converging chamber directly connected to the heating element; air is pulled in via the air inlet and the turbo axial fan blade for a first stage of compression; and the heating element and converging chamber provide additional stages of compression.

4 Claims, 5 Drawing Sheets

MULTISTAGE AIR COMPRESSOR UNIT AND METHOD OF USE

BACKGROUND

1. Field of the Invention

The present invention relates generally to air compressors and heaters, such as are conventionally used in hand and hair dryers, and more specifically to a multi stage air compressor unit having components configured to create enough pressure to push heated air through an elongated conduit.

2. Description of Related Art

Air heaters, as are conventionally used in blow dryers and the like, are well known in the art. For example, FIG. 1 depicts a conventional air heating system 101 having a fan 103, a motor 105, and a heating element 107. During use, the motor and fan pull air into the dryer and push the air past the heating element 107.

One of the problems commonly associated with system 101 is efficiency. For example, it in conventional methods, there is not enough pressure generated to push the air very far.

Accordingly, although great strides have been made in the area of air heating systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
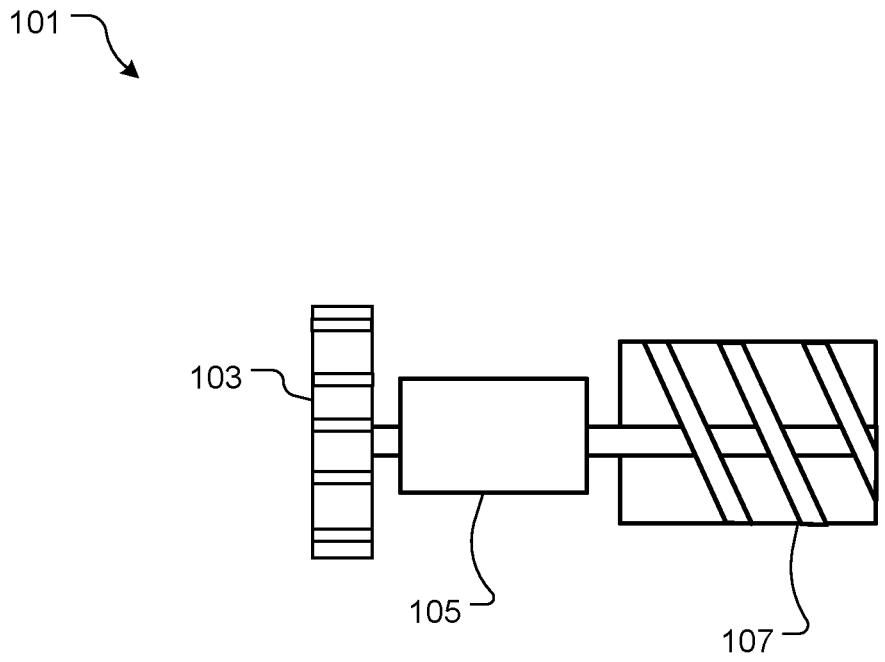
FIG. 1 (Prior Art)
FIG. 1 is a simplified side view of a conventional air heating system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional air heating systems. Specifically, the present invention provides a simple apparatus with multiple stages of compression, thereby providing a means to greatly pressurize and heat air to then push the air through an elongated chamber. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
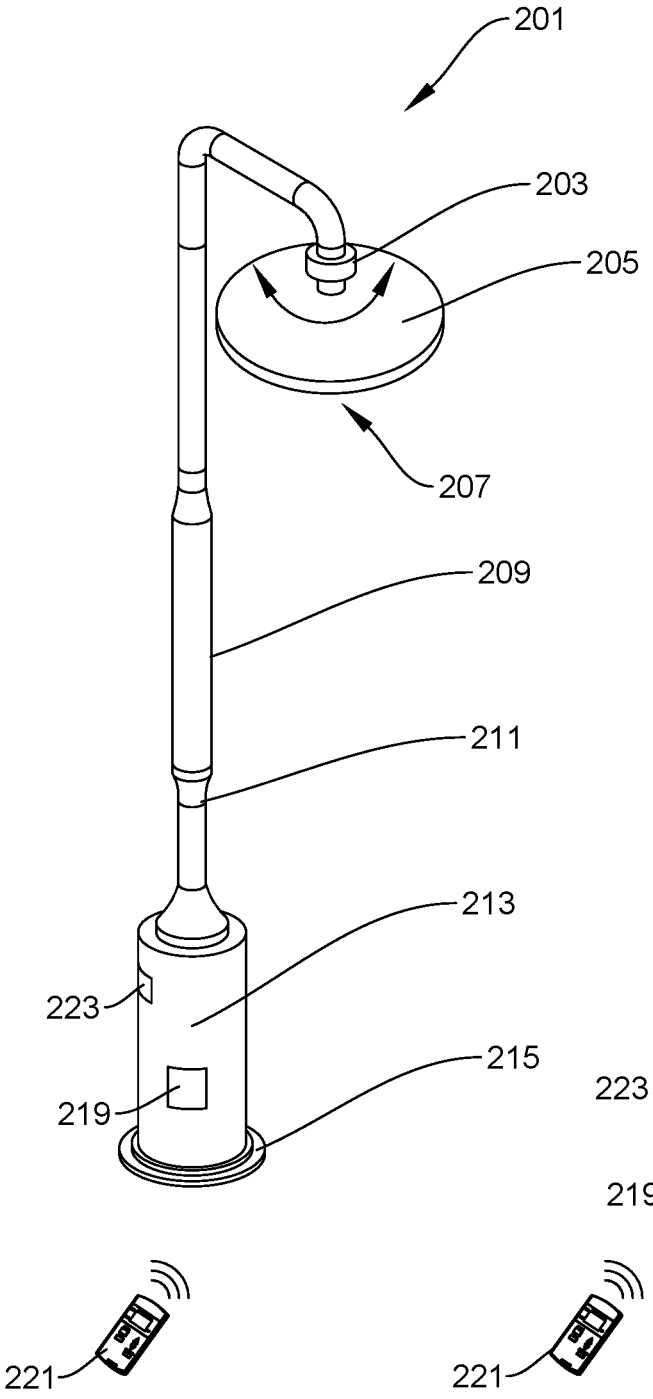
FIGS. 2A and 2B are oblique views of a body dryer system incorporating the multistage air compressor unit in accordance with a preferred embodiment of the present application.
Figure 2B:
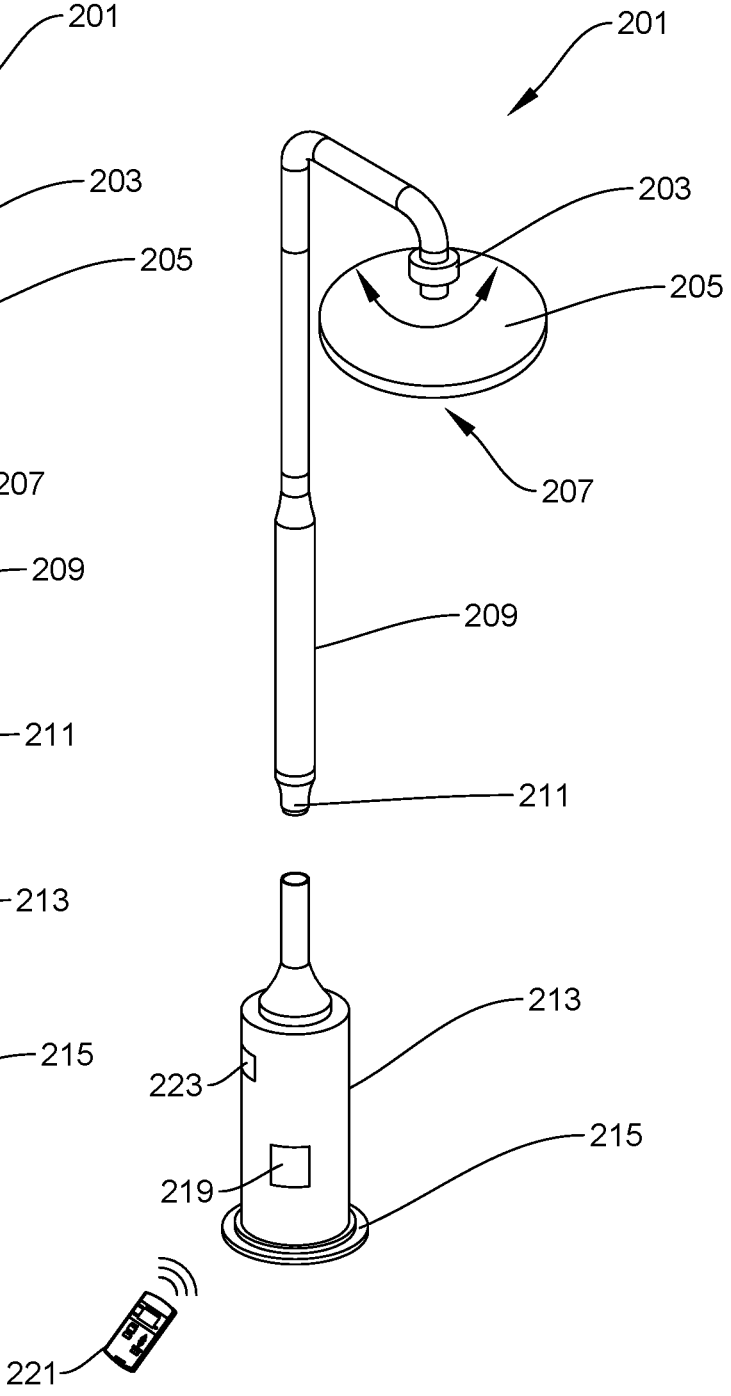

Referring now to the drawings wherein like reference characters identify corresponding or similar elements throughout the several views, FIGS. 2A and 2B depict oblique views of a body dryer system 201 in accordance with a preferred embodiment of the present application. It will be appreciated that system 201 overcomes one or more of the above-listed problems commonly associated with conventional body dryer systems.

In the contemplated embodiment, system 201 includes an elongated and adjustable tower 209 extending from a drive unit 213 to head unit 205 having. It should be appreciated that in the preferred embodiment, the adjustable tower 209 is a thin, pipe-like, elongated flow conduit, thereby making system 201 compact and easy to move. In addition, the compact nature of system 201 allows for the system to be used in small bathrooms.

In some embodiments, the head 205 is attached via a swivel mechanism 203, thereby allowing for the head to turn and pivot, as shown with the arrow. It should be appreciated that head 205 can further vary in size and shape as desired. In some embodiments, head 205 further includes a sensor 207 configured to sense the presence of a user underneath the sensor. It is contemplated that the sensor 207 could be infrared, motion, or any other means.

System 201 can further include a quick connection 211 can be configured to allow a top portion of system 201 to disconnect from drive unit 213. This feature would allow for the drive unit to be used independent of the other elements.

System 201 can further include a rechargeable battery unit 215 attached to base 213. Alternatively, system 201 could include cords (not shown) to allow for system 201 to be plugged in.

System 201 can further include a control system 219 configured to operate system 201. Control system 219 can command features such as temperature, power, and activation. In some embodiments, control system 219 can be configured to wirelessly communicate with a remote device 221, such as a remote, or mobile phone.

In the preferred embodiment, the drive unit comprises at least a turbo axial fan blade, a motor, a heating element, and an electronic control module 219 configured to pull in and pressurize air to be transmitted to the head unit.

It is contemplated that system 201 can include additional features, such as a scent pocket 223 wherein the user can input scents, such as essential oils, that will then be dispersed via head 205. Further, it is contemplated that in some embodiments, the system can function as a room heater, as opposed to a body dryer. In addition, in some embodiments, the drive unit can be used for other applications, such as a leaf blower.

It should be appreciated that one of the unique features believed characteristic of the present application is the compact nature of system 201, thereby allowing for the use of system 201 in compact spaces.

Figure 3:
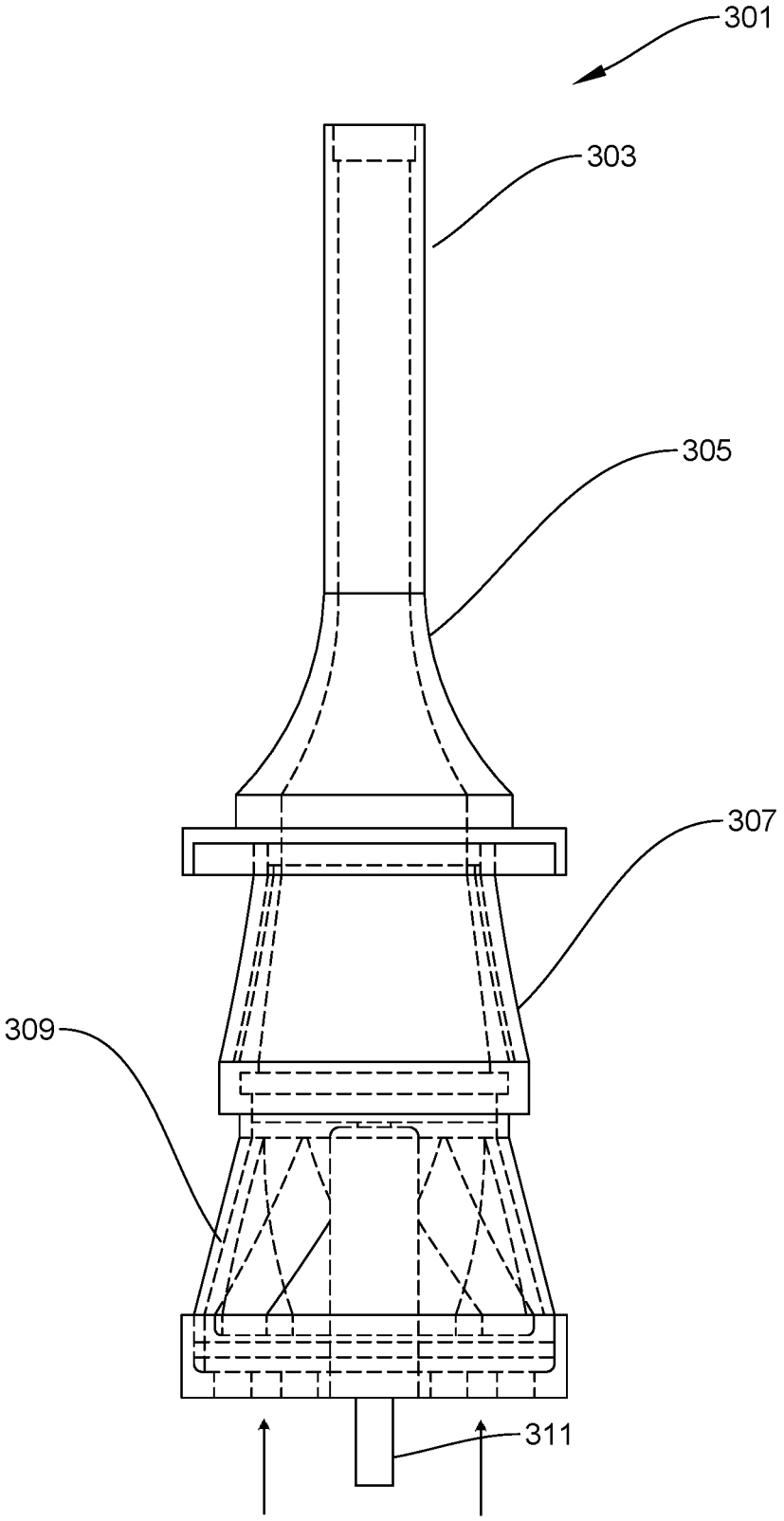
FIG. 3 is a front view of an embodiment of the air compressor unit of FIGS. 2A and 2B.

In FIG. 3, a front view of a drive unit 301, as a multi-stage air compressor, is shown. In the preferred embodiment, a flow discharge unit 303 having a tapered converging end 305 is connected to a heating element 307 assembly. The heating assembly 307 is further connected to a turbo axial fan blade assembly 309 operated via a motor. During use, air is pulled into the assembly (as shown with arrows) wherein a fluid driver shaft is in communication with the turbo axial fan blade assembly and the air is compressed via the turbo compressor assembly 309. The compressed air is forced into the heating element assembly, wherein the heat further pressurizes the air. The air is then pushed through the converging chamber 305 and into the flow discharge unit, wherein the converging chamber further compresses and pressurizes the air. This system creates highly pressured air that can travel quickly from the unit 213 and to the head 205 to be exerted onto the user.

Figure 4:
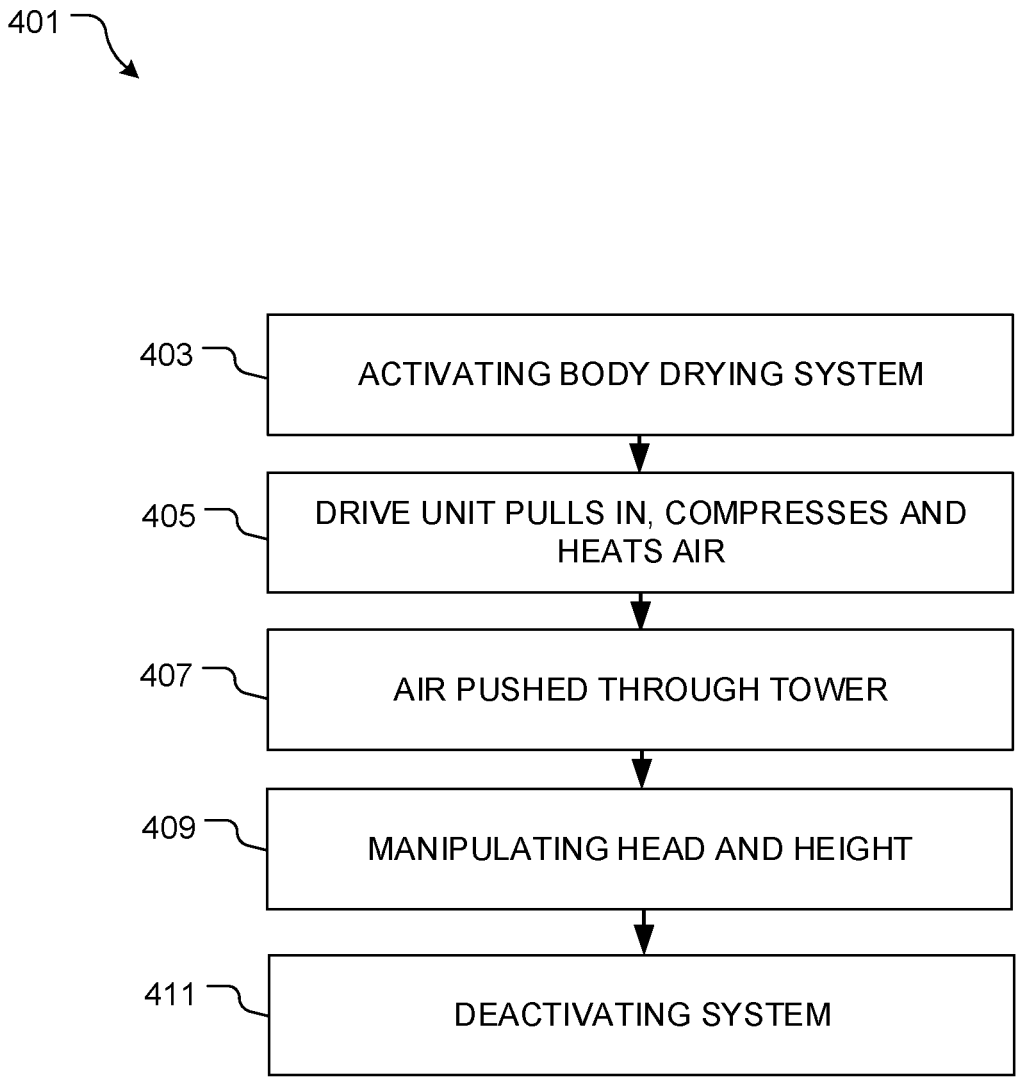
FIG. 4 is a flowchart of the method of use of the body dryer system of FIGS. 2A and 2B.

In FIG. 4, a flowchart 401 depicts the method of use of system 201. During use, system 201 is activated, either via a control directly on driver unit 213, or via a remote device, as shown with box 403. The drive unit begins the process of compressing/pressurizing and heating air, as shown with box 405. The warm air is pushed through tower 209 to head 205, wherein the air is exerted onto the user, as shown with box 407. As desired, the user can manipulate the angle of the head and adjust the height of the tower 209, as shown with box 409. Once the user is dry, the user deactivates system 201, as shown with box 411.

Figure 5:
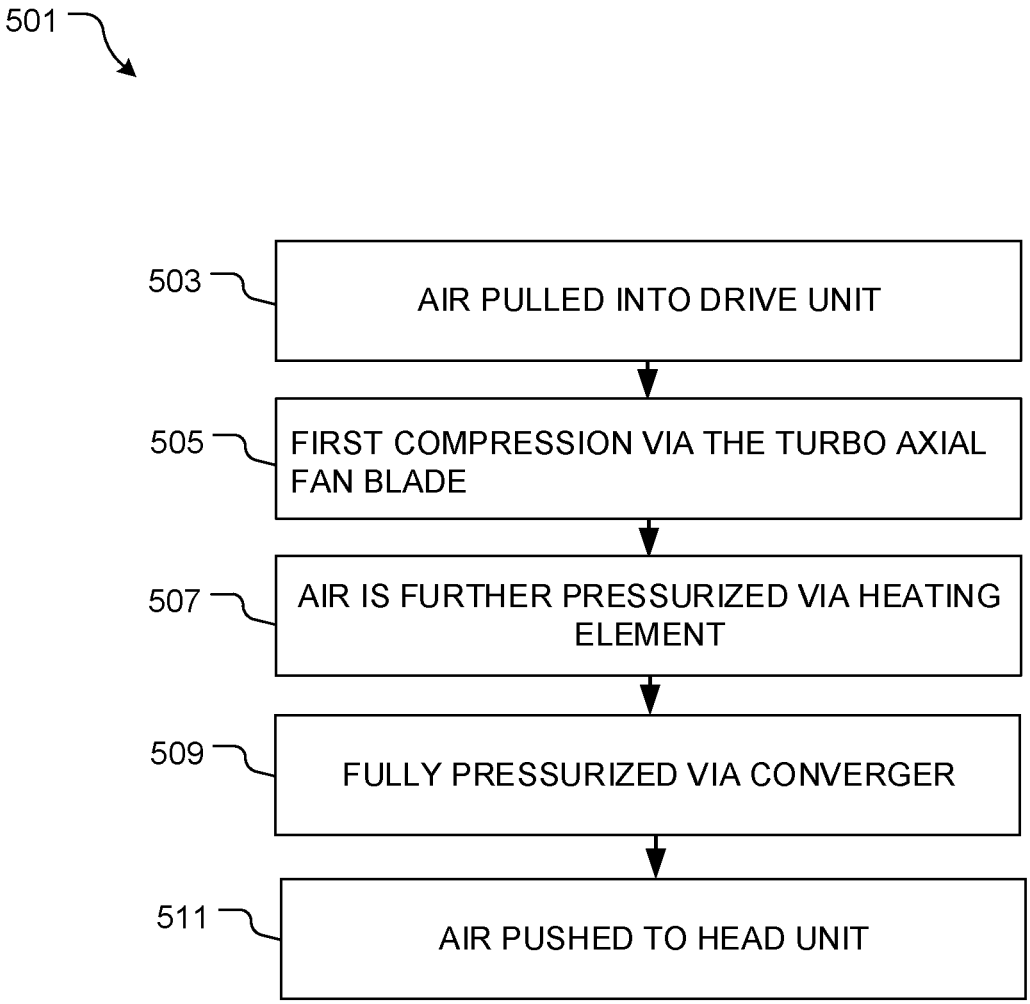
FIG. 5 is a flowchart of the method of use of the air compressor unit of FIG. 3.

In FIG. 5, a flowchart 501 depicts the method of use of drive unit 301. During use, air is pulled into drive unit, as shown with box 503. The air goes through a first stage of compression/pressurization via turbo axial fan blade 309, as shown with box 505. The air is then pushed into the heating element 307, wherein the heat further pressurizes the air, as shown with box 507. As the air is further pushed into converger 305, the air is fully pressurized with enough force to easily reach and expel from the head unit, thereby providing comfortable heat and force to the user, as shown with boxes 509, 511.

It should be appreciated that another unique feature believed characteristic of the present invention is the drive unit 301. It should be appreciated that the drive unit is not limited to a body dryer, and could be used in a hand dryer, hair dryer, or any other apparatus in which it is desirable to create pressurized air in a compact space.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A multistage air compressor unit, comprising:

an elongated housing forming an inner cavity and having:

a base configured to carry a plurality of batteries and configured to rest on a ground surface;

an opening extending through a wall thickness, the opening forming a scent pocket configured to removably contain a scent packet therein; and an air inlet;

a turbo axial compressor having a turbo axial fan blade operated via a motor;

a heating element in direct communication with the turbo axial compressor;

a converging chamber directly connected to the heating element;

an elongated tower extending from a first end to a second end;

a quick-disconnect secured to the converging chamber and the first end of the elongated tower, the quick-disconnect is configured to removably engage the elongated tower from the elongated housing;

a head secured to the second end of the elongated tower;

a swivel secured disposed between the head and the second end, the swivel is configured to allow rotational movement of the head relative to the second end; and a sensor secured to the head, the sensor is configured to sense a user proximate to the head;

wherein air is pulled in via the air inlet and the turbo axial fan blade for a first stage of compression; and wherein the heating element and converging chamber provide additional stages of compression.

2. The unit of claim 1, further comprising:

a flow discharge unit extending from the converging chamber.

3. The unit of claim 1, wherein the converging chamber has tapered sides extending from a first end to a second end.

4. A method of compressing air, the method comprising:

providing the unit of claim 1;

intaking air through the air inlet and into the turbo axial fan blade;

creating a first stage of compression via the turbo axial fan blade;

moving air into the heating element;

creating a second stage of compression via the heating element; moving air into the converging chamber; and creating a third stage of compression via the converging chamber.

* * * * *